United States Patent [19]

Yagasaki

[11] Patent Number: 4,855,648

[45] Date of Patent: Aug. 8, 1989

[54] CONTROL DEVICE FOR COPIER OR THE LIKE

[75] Inventor: Toshiaki Yagasaki, Hino, Japan

[73] Assignee: Canon Kabushiki Kaisha, Tokyo, Japan

[21] Appl. No.: 73,881

[22] Filed: Jul. 16, 1987

Related U.S. Application Data

[63] Continuation of Ser. No. 746,576, Jun. 19, 1985, abandoned, which is a continuation of Ser. No. 461,166, Jan. 26, 1983, abandoned.

[30] Foreign Application Priority Data

| | | | |
|---|---|---|---|
| Feb. 4, 1982 | [JP] | Japan | 67-16586 |
| Feb. 4, 1982 | [JP] | Japan | 67-16587 |
| Feb. 4, 1982 | [JP] | Japan | 67-16588 |
| Jul. 20, 1982 | [JP] | Japan | 67-126259 |

[51] Int. Cl.[4] ..... G03G 15/00

[52] U.S. Cl. ..... 315/307; 355/68; 355/69; 355/208

[58] Field of Search ..... 430/31, 33; 355/3 R, 355/14 E, 67–71; 315/307

[56] References Cited

U.S. PATENT DOCUMENTS

| | | | |
|---|---|---|---|
| 4,153,364 | 5/1979 | Suzuki et al. | 355/14 E |
| 4,177,406 | 12/1979 | Hermeyer et al. | 315/307 |
| 4,221,994 | 9/1980 | Friedman et al. | 315/307 |
| 4,253,048 | 2/1981 | Osako | 315/107 X |
| 4,460,270 | 7/1984 | Watai et al. | 315/14 E |

OTHER PUBLICATIONS

T.M.S. 2100/2300 Series User's Manual, Texas Instruments, Inc., Nov. 1980.

*Primary Examiner*—Howard W. Britton
*Assistant Examiner*—Mark R. Powell
*Attorney, Agent, or Firm*—Fitzpatrick Cella Harper & Scinto

[57] ABSTRACT

A digital device for controlling the power supply to various loads, by converting the state of the loads or the peak value of the power supply voltage into digital values and instantly determining the power supply to the loads.

19 Claims, 13 Drawing Sheets

200
INT
A/D
RESET
I1
I2
I3
I4
I5
I6
O1
O2
O3
O4
O5
O6
O7
O8
O9
O10
CKP
MAIN MOTOR
208
HALOGEN LAMP DRIVE CCT
209
FEED CLUTCH
210
REG CLUTCH
211
H.V. SOURCE
212
OPTICAL SYS FORWARD CLUTCH
213
NO SHEET LAMP
214
JAM DISPLAY
215
216
POWER LAMP
221
PEAK VALUE DETECTION CCT
220
218
(a)
(b)
ALL WAVE RECTIFIER
217
AC
PS 1
201
PS 2
202
PS 3
203
FEEDOUT EXIT SENSOR
204
FEED SENSOR
205
COPY START. STOP
206

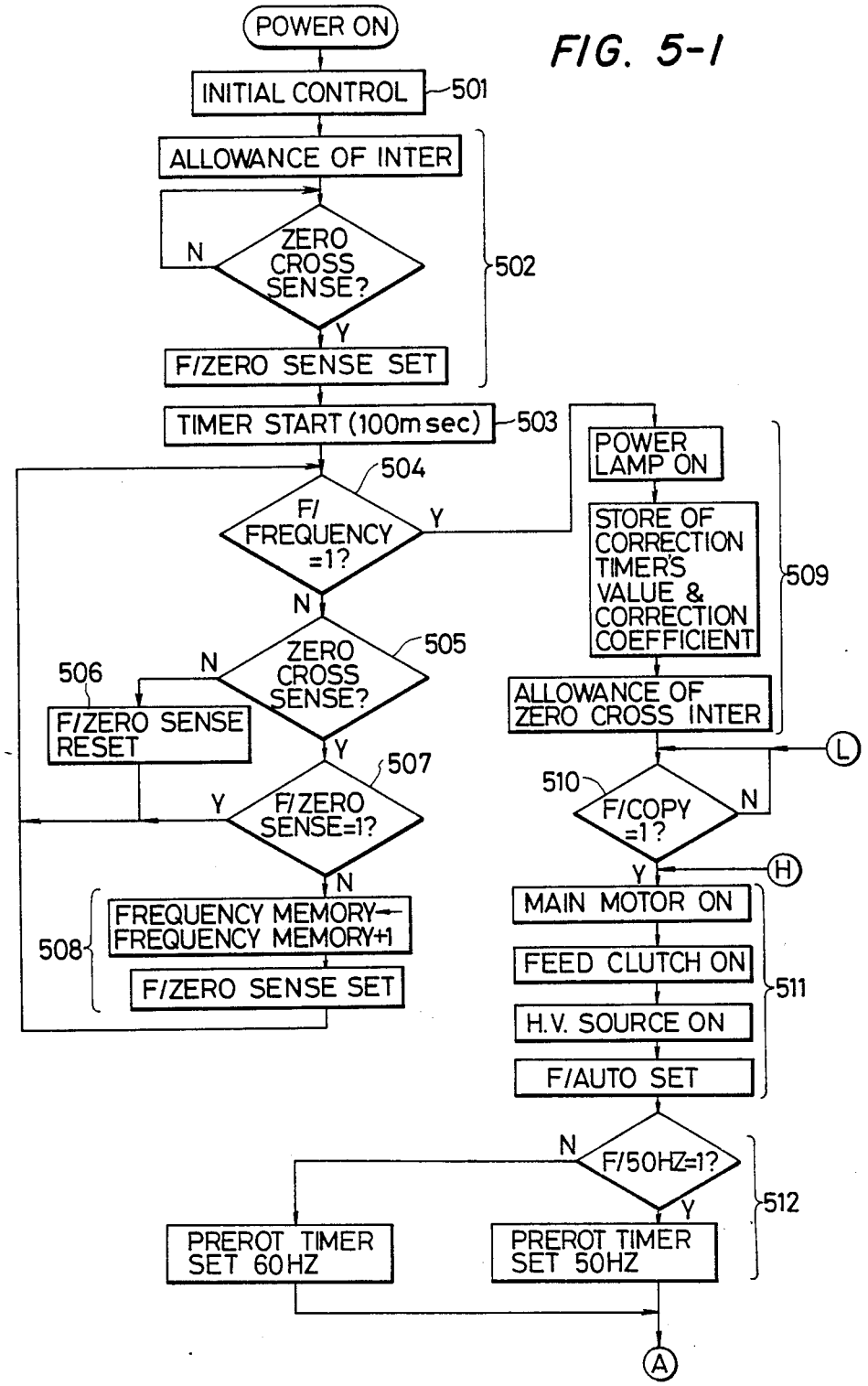
FIG. 5-1
POWER ON
INITIAL CONTROL
501
ALLOWANCE OF INTER
ZERO CROSS SENSE?
N
Y
502
F/ZERO SENSE SET
TIMER START (100m sec)
503
504
F/ FREQUENCY =1?
Y
N
ZERO CROSS SENSE?
505
506
N
F/ZERO SENSE RESET
Y
507
F/ZERO SENSE=1?
Y
N
508
FREQUENCY MEMORY← FREQUENCY MEMORY+1
F/ZERO SENSE SET
POWER LAMP ON
STORE OF CORRECTION TIMER'S VALUE & CORRECTION COEFFICIENT
509
ALLOWANCE OF ZERO CROSS INTER
L
510
F/COPY =1?
N
Y
H
MAIN MOTOR ON
FEED CLUTCH ON
H.V. SOURCE ON
F/AUTO SET
511
F/50HZ=1?
N
Y
512
PREROT TIMER SET 60HZ
PREROT TIMER SET 50HZ
A

CONTROL DEVICE FOR COPIER OR THE LIKE

This application is a continuation of application Ser. No. 746,576 filed June 19, 1985 which was a continuation of application Ser. No. 461,166, filed Jan. 23, 1983, both now abandoned.

BACKGROUND OF THE INVENTION

1. Field of the Invention

The present invention relates to a control device for controlling various loads in a copier or the like, such as light source or heat source.

2. Description of the Prior Art

In the field of copiers and the like there is already known a method for controlling for example the amount of light from a light source, by comparing the voltage supplied to the light source with a reference voltage and controlling the power to be supplied to said light source according to a signal obtained from said comparison.

Such control method, if conducted in analog form, is unable to rapidly responding to the noises from other devices in the apparatus, thus often giving rise to erroneous control. Such erroneous control is undesirable particularly in a copier utilizing a photosensitive member, since even a slight change in the amount of light from the light source will significantly affect the image contrast.

Also in such control method, the power supply to the loads such as the light source is generally initiated at the start of power supply to the apparatus or in response to an instruction for starting the copying operation. In such case, the amount of power supply to said loads is usually same as in the normal copying operation. However, an initial power supply to the light source same as in the normal operation may lead to damages in the elements such as transistors and triacs for light control because of a surge current.

Also in case of controlling a load such as the light source by an AC power source, the sinusoidal waveform at the positive side is not completely symmetrical with that at the negative side. Consequently a phase control for the sinusoidal waveform of the positive side based on the obtained from the sinusoidal waveform of the negative side may lead to an error in the control, thus making satisfactory power supply impossible.

SUMMARY OF THE INVENTION

In consideration of the foregoing, the object of the present invention is to provide a digital control device for controlling the power supply to the loads, and, more specifically, such control device capable of appropriately converting the state of such loads or the peak, average or mean value of the power supply voltage into digital signals and accordingly determining the amount of power supply to the loads instantly, thereby achieving exact control.

Another object of the present invention is to provide a control device capable of digital control for the power supply to an image forming apparatus and of correcting the quantum error resulting from the digital control thereby achieving a further accurate control.

Still another object of the present invention is to provide a control device capable of preventing the surge current at the start of power supply, thereby preventing the damage to the elements for power supply control.

Still another object of the present invention is to provide a control device capable of an errorless control of power supply to an AC-driven load.

The foregoing and still other objects of the present invention will become fully apparent from the following description.

BRIEF DESCRIPTION OF THE DRAWINGS

FIGS. 5-1 to 5-4 inclusive are control flow charts of the copier shown in FIG. 1;

FIGS. 7-1 and 7-2 are flow charts showing an interruption program;

DETAILED DESCRIPTION OF THE PREFERRED EMBODIMENTS

Now the present invention will be explained in detail by an embodiment in which the present invention is applied to the control of the amount of light.

Figure 1:
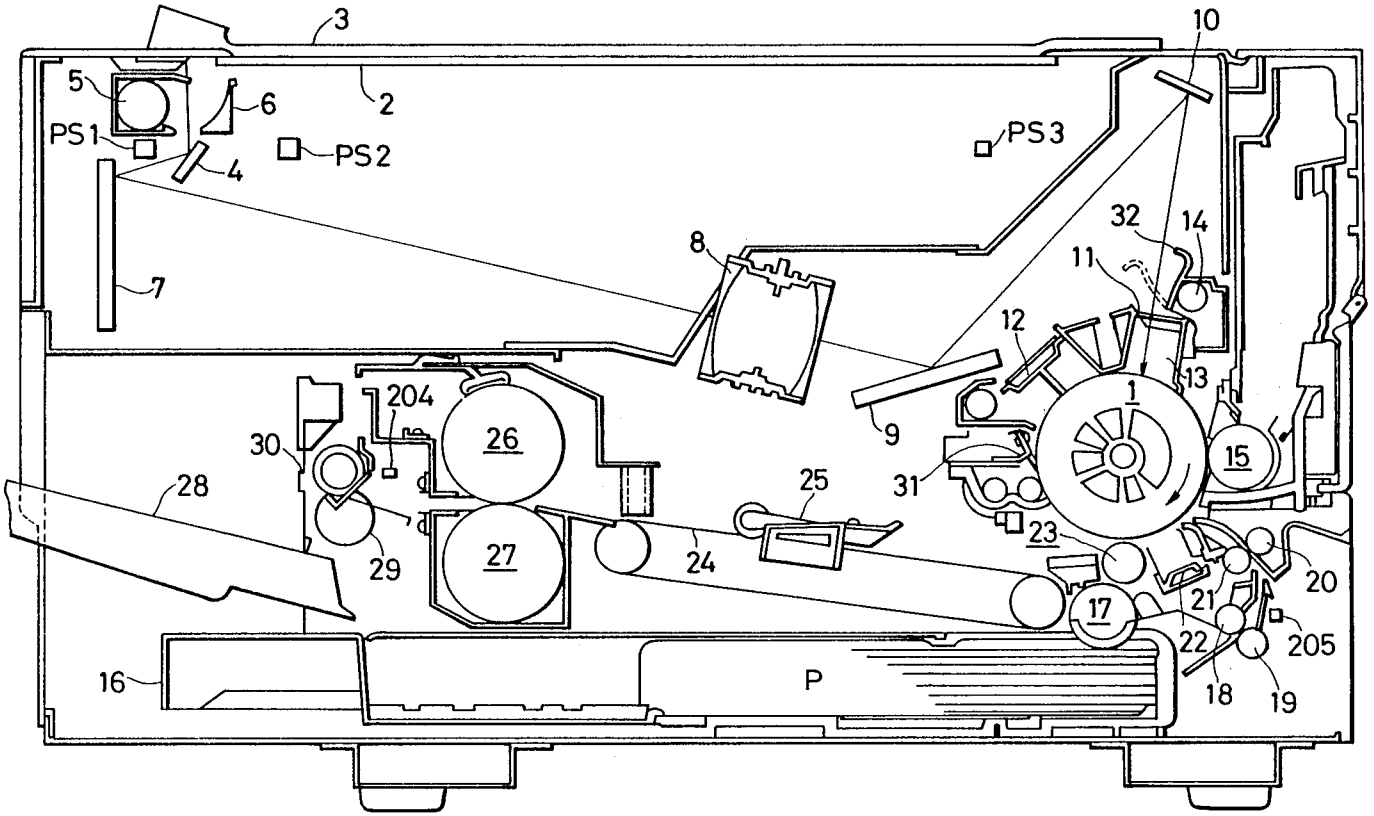
FIG. 1 is a cross-sectional view of a copier embodying the present invention.

FIG. 1 shows, in a cross-sectional view, a copier embodying the present invention.

A rotatably supported photosensitive drum 1 is provided at the periphery thereof with a photosensitive member employing a photoconductive material, and starts to rotate in a direction of arrow in response to a copying instruction.

An original document placed on a carrier glass 2 and maintained in position by a cover 3 is illuminated by the light from a halogen lamp 5 and from a main reflector 6 which are integrally constructed with a first mirror 4, and the light reflected by the original is scanned by the first mirror 4 and a second mirror 7. Said mirrors 4, 7 are displaced at a speed ratio of 1 :½ to maintain a constant optical path length in front of a lens 8 during the scanning operation of the original.

The reflected light is focused, through the lens 8, a third mirror 9 and a fourth mirror 10 onto the photosensitive drum 1 in an exposure station 11.

The photosensitive drum 1 is in advance charged, for example positively, by a primary charger 12 and then is subjected to slit exposure of the image illuminated by said halogen lamp 5 in said exposure station 11.

Simultaneously an AC charge elimination or a DC charge elimination of a polarity opposite to that of the primary charging, for example negative charge elimination is conducted by the charge eliminator 13, and a uniform illumination by a flush exposure lamp 14 is subsequently given to form an electrostatic latent image of an elevated contrast on the photosensitive drum 1. Said latent image is developed into a visible toner image by a developing device 15.

The transfer sheet P in a cassette 16 is supplied into the apparatus by a feed roller 17, and is advanced by transport rollers 18, 19 to registering rollers 20, 21, which forwards said transfer sheet P at an exact timing toward the photosensitive drum 1.

The toner image on the photosensitive drum 1 is then transferred onto said transfer sheet P during passage thereof between said drum 1 and a transfer charger 22.

After said image transfer, the transfer sheet is separated from the photosensitive drum 1 by a separating roller 23, and is guided to a conveyor belt 24 provided thereon with a sheet pressing roller 25. The transfer sheet is then introduced into paired rollers 26, 27 for fixing the toner image by heat and pressure, and is ejected by ejecting rollers 29, 30 onto a tray 28.

The photosensitive drum 1 after image transfer is surfacially cleaned by a cleaning device composed of an elastic blade 31 and proceeds to the succeeding imaging cycle. A blank shutter 32 is provided for subjecting the drum 1 either to an imagewise exposure or to a blank exposure.

Switches PS1, PS2 and PS3 are actuated by the optical system composed of the first mirror 4, halogen lamp 5 and second mirror 7, wherein the switch PS1 functions as a home position sensor for detecting whether the optical system is present at a home position for starting the exposure step, while the switch PS2 functions as a registering sensor generating signals for driving the registering rollers 20, 21 at determined timings, and the switch PS3 functions as a reversing position sensor for detecting whether the optical system is present at a reversing position after the exposure step.

Also there are provided a sheet exit sensor 204 and a sheet feeding sensor 205.

Figure 2:
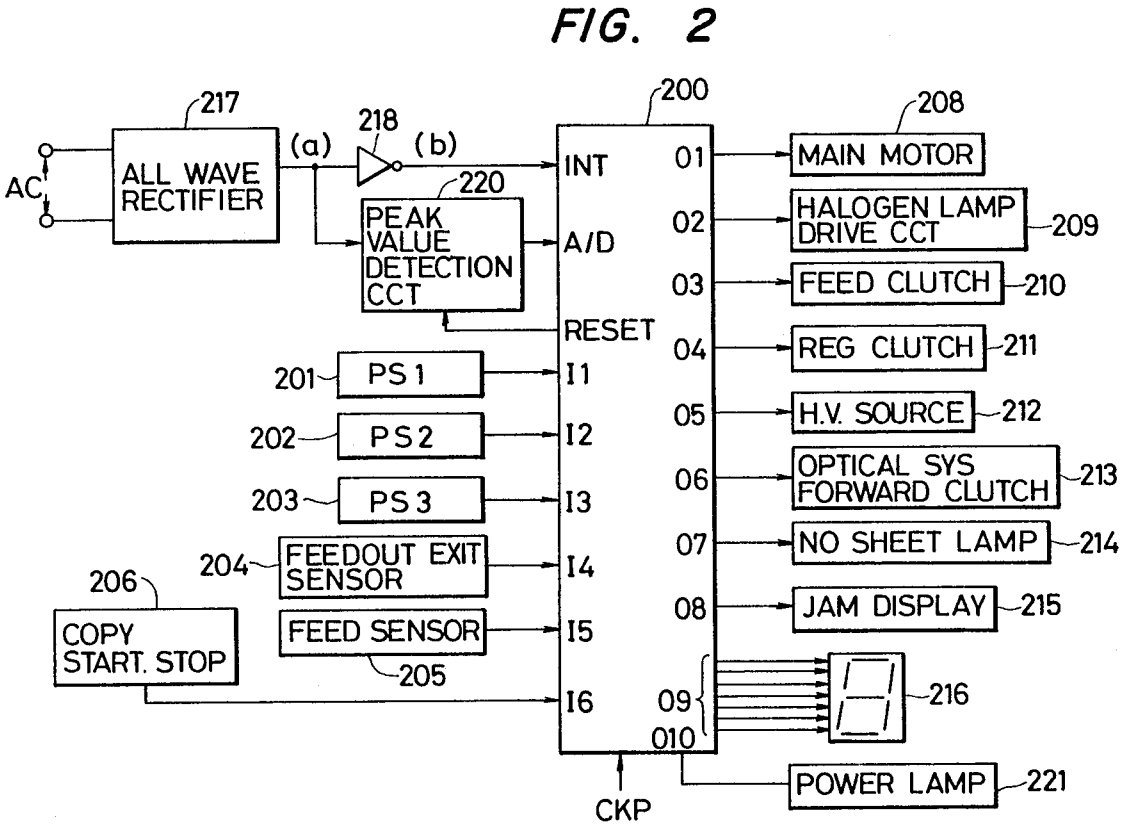
FIG. 2 is a block diagram of a control circuit of the copier shown in FIG. 1.
Figure 3A:
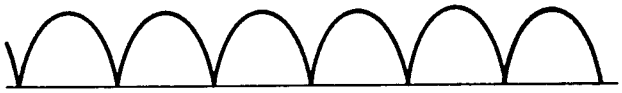
FIG. 3*a* and 3*b* are waveform chart showing various output voltages.
Figure 3B:
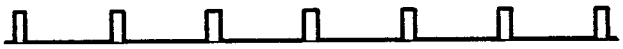

FIG. 2 is a block diagram showing the control circuit of the copier shown in FIG. 1. A control unit 200 is composed of a microcomputer incorporating an A/D converter, such as a microcomputer known as TMS 2300 supplied by Texas Instruments Corp. Said control unit may also be of a structure to be used in combination with an external A/D converter. Input ports I1–I6 of the control unit respectively receive input signals from the home position sensor 201 (PS1 in FIG. 1), registering sensor 202 (PS2 in FIG. 1), reversing position sensor 203 (PS3 in FIG. 1), sheet exit sensor 204 for detecting the ejection of a sheet onto the tray 28, sheet feeding sensor 205 for detecting the normal feeding of a sheet, and a copy start/stop signal from keys in an unrepresented operating unit.

Also output ports O1–O10 of the control unit 200 release signals for controlling a main motor 208 for driving photosensitive drum 1, feeding roller 17, registering rollers 20, 21 etc.; a halogen lamp lighting circuit 209; a sheet feeding clutch 210 for transmitting the driving force of the main motor to the sheet feeding roller 17; a registering clutch 211 for transmitting the driving force of the main motor to the registering rollers 20, 21; a high voltage source 212 for supplying high voltages to the primary charger 12, transfer charger 22 etc.; an optical system forward clutch 213 for controlling the forward movement of the optical system; a no-sheet lamp 214 to be lighted when the cassette 16 is not mounted on the apparatus; a jam display 215 for indicating the presence of sheet jamming in the apparatus; a 7-segment numeral display 216 for indicating the set copy number to be entered from the unrepresented operating unit; and a power supply lamp 221 provided in the operating unit for indicating the presence of power supply.

An all-wave rectifier 217 receives an AC power supply, and an inverter 218 of a determined threshold level receives thus rectified power supply and supplies an output signal to an interruption port INT of the control unit 200.

Figures 2, 5:
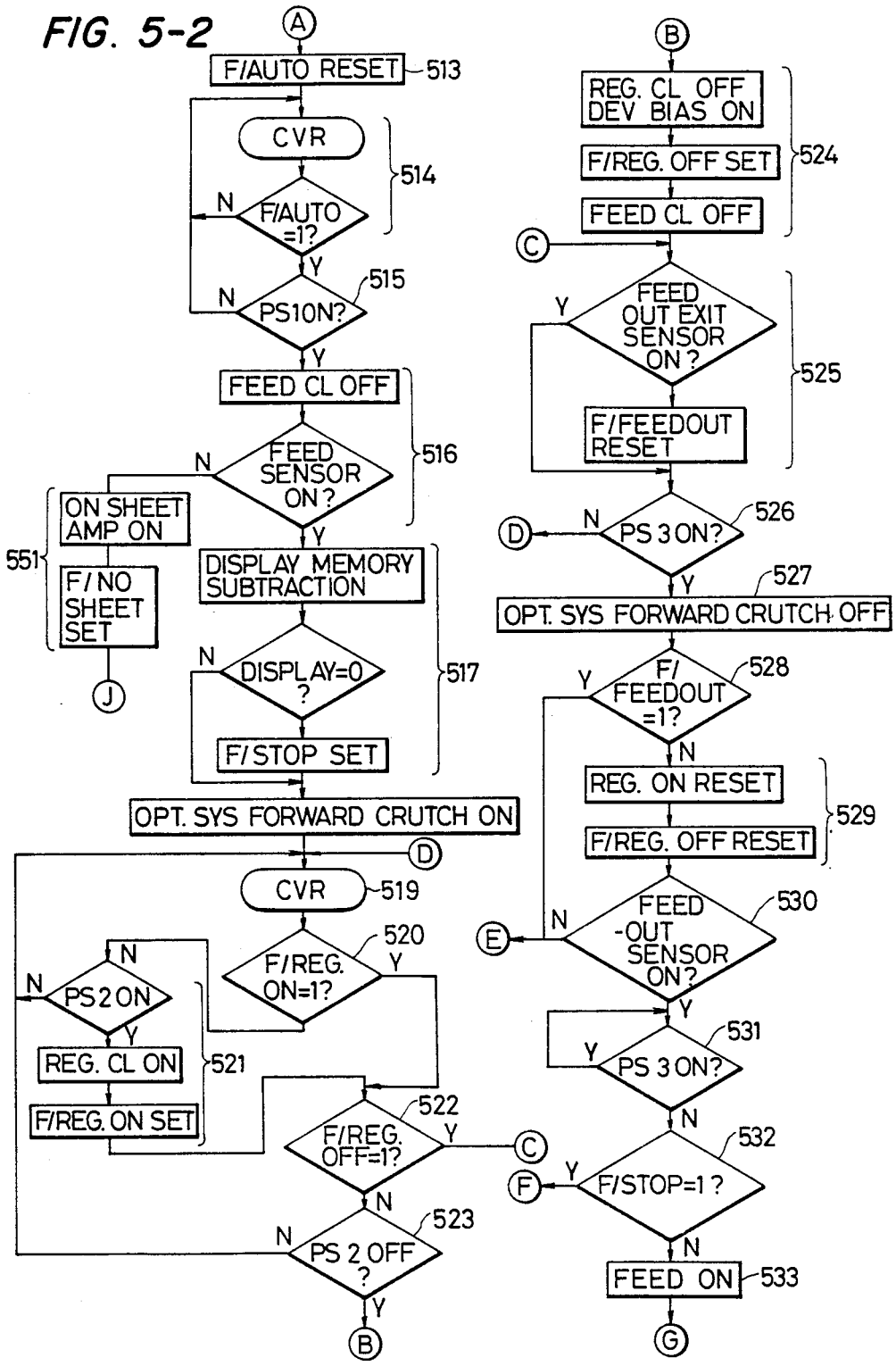
Figures 3, 5:
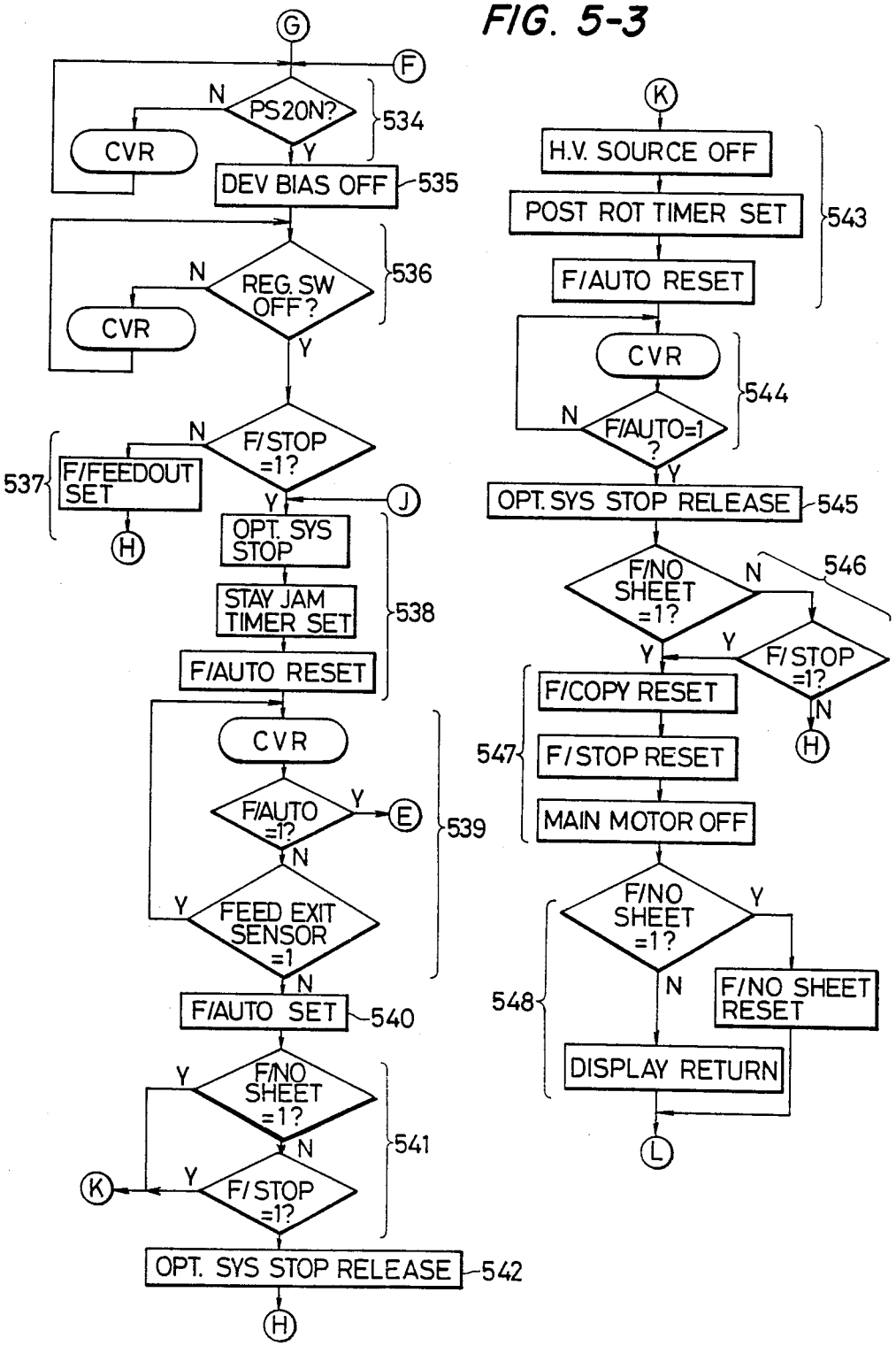
Figures 4, 5:
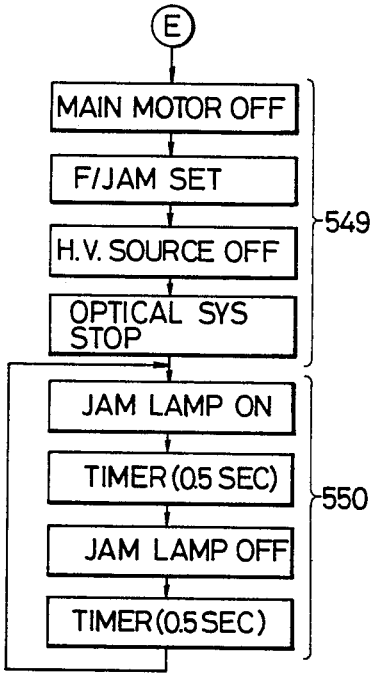

FIG. 3 shows the waveforms of the output voltage (a) from the all-wave rectifier 217 and of the output voltage (b) from the inverter 218. As will be apparent from these charts, at the zero-crossing points of the voltage (a), the inverter 218 releases the output voltages (b) which will hereinafter be called zero-cross signals.

A peak value detecting circuit 220 receives the output voltage (a) from the all-wave rectifier 217 and detects the peak value of said voltage. In case said voltage is of a distortion-free sinusoidal form, said peak value can be regarded as a mean or effective value of said voltage. The detected peak voltage is supplied to an analog-to-digital converting port A/D of the control unit 200. The control unit 200 reads said input signal at a determined timing and convert it into an 8-bit digital signal as shown in Tab.1, which is represented in hexadecimal numbers. The detected peak value is reset by an output signal from a RESET port of the control unit 200.

The control unit 200 executes the sequence control of various parts of the copier in response to the input signals to the input ports I1–I6, interruption port INT and analog-to-digital converting port A/D and according to control programs stored in a read-only memory (ROM) incorporated in the microcomputer.

TABLE 1

| Input voltage | Upper digit | Lower digit | Input voltage | Upper digit | Lower digit |
|---|---|---|---|---|---|
| 80.0 | 1 | 0 | 96.0 | 5 | 0 |
| 80.5 | 1 | 2 | 96.5 | 5 | 2 |
| 81.0 | 1 | 4 | 97.0 | 5 | 4 |
| 81.5 | 1 | 6 | 97.5 | 5 | 6 |
| 82.0 | 1 | 8 | 98.0 | 5 | 8 |
| 82.5 | 1 | A | 98.5 | 5 | A |
| 83.0 | 1 | C | 99.0 | 5 | C |
| 83.5 | 1 | E | 99.5 | 5 | E |
| 84.0 | 2 | 0 | 100.0 | 6 | 0 |
| 84.5 | 2 | 2 | 100.5 | 6 | 2 |
| 85.0 | 2 | 4 | 101.0 | 6 | 4 |
| 85.5 | 2 | 6 | 101.5 | 6 | 6 |
| 86.0 | 2 | 8 | 102.0 | 6 | 8 |
| 86.5 | 2 | A | 102.5 | 6 | A |
| 87.0 | 2 | C | 103.0 | 6 | C |
| 87.5 | 2 | E | 103.5 | 6 | E |
| 88.0 | 3 | 0 | 104.0 | 7 | 0 |
| 88.5 | 3 | 2 | 104.5 | 7 | 2 |
| 89.0 | 3 | 4 | 105.0 | 7 | 4 |
| 89.5 | 3 | 6 | 105.5 | 7 | 6 |
| 90.0 | 3 | 8 | 106.0 | 7 | 8 |
| 90.5 | 3 | A | 106.5 | 7 | A |
| 91.0 | 3 | C | 107.0 | 7 | C |
| 91.5 | 3 | E | 107.5 | 7 | E |
| 92.0 | 4 | 0 | 108.0 | 8 | 0 |
| 92.5 | 4 | 2 | 108.5 | 8 | 2 |
| 93.0 | 4 | 4 | 109.0 | 8 | 4 |
| 93.5 | 4 | 6 | 109.5 | 8 | 6 |
| 94.0 | 4 | 8 | 110.0 | 8 | 8 |
| 94.5 | 4 | A | 110.5 | 8 | A |
| 95.0 | 4 | C | 111.0 | 8 | C |
| 95.5 | 4 | E | 111.5 | 8 | E |
| 112.0 | 9 | 0 | 126.0 | C | 8 |
| 112.5 | 9 | 2 | 126.5 | C | A |
| 113.0 | 9 | 4 | 127.0 | C | C |
| 113.5 | 9 | 6 | 127.5 | C | E |
| 114.0 | 9 | 8 | 128.0 | D | 0 |
| 114.5 | 9 | A | 128.5 | D | 2 |
| 115.0 | 9 | C | 129.0 | D | 4 |
| 115.5 | 9 | E | 129.5 | D | 6 |
| 116.0 | A | 0 | 130.0 | D | 8 |
| 116.5 | A | 2 | 130.5 | D | A |
| 117.0 | A | 4 | 131.0 | D | C |
| 117.5 | A | 6 | 131.5 | D | E |
| 118.0 | A | 8 | 132.0 | E | 0 |
| 118.5 | A | A | 132.5 | E | 2 |

TABLE 1-continued

| Input voltage | Upper digit | Lower digit | Input voltage | Upper digit | Lower digit |
|---|---|---|---|---|---|
| 119.0 | A | C | 133.0 | E | 4 |
| 119.5 | A | E | 133.5 | E | 6 |
| 120.0 | B | 0 | 134.0 | E | 8 |
| 120.5 | B | 2 | 134.5 | E | A |
| 121.0 | B | 4 | 135.0 | E | C |
| 121.5 | B | 6 | 135.5 | E | E |
| 122.0 | B | 8 | 136.0 | F | 0 |
| 122.5 | B | A | 136.5 | F | 2 |
| 123.0 | B | C | 137.0 | F | 4 |
| 123.5 | B | E | 137.5 | F | 6 |
| 124.0 | C | 0 | 138.0 | F | 8 |
| 124.5 | C | 2 | 138.5 | F | A |
| 125.0 | C | 4 | 139.0 | F | C |
| 125.5 | C | 6 | 139.5 | F | E |

Figure 4:
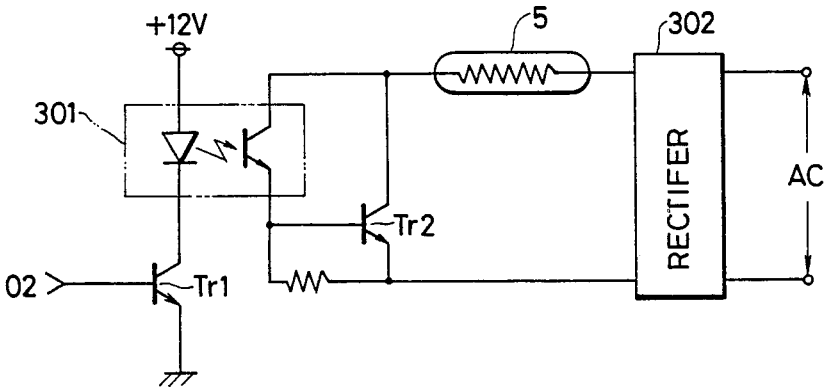
FIG. 4 is a detailed circuit diagram for lighting a halogen lamp shown in FIG. 2.

FIG. 4 is a detailed circuit diagram of the halogen lamp lighting circuit 209 shown in FIG. 2, wherein provided are a photocoupler 301, a rectifier 302 for all-wave rectification of AC power supply, a halogen lamp 5, and transistors Tr1, Tr2.

The transistor Tr1 receives, at the base thereof, the output signal of the output port 02 of the control unit 200 and is turned on and off according to the output level of said port 02. When said transistor Tr1 is turned off in this circuit, the light-emitting element of the photocoupler 301 is not energized, so that the photoreceptor thereof is also turned off. Consequently the transistor Tr2 is turned off, whereby the rectifier 302 does not supply power to the halogen lamp 5. On the other hand, when the transistor Tr1 is turned on, said lighte-mitting element emits light to generate a signal from the photoreceptor, whereby the transistor Tr2 is turned on to enable power supply to the halogen lamp 5.

In this manner the power supply to the halogen lamp 5 is controlled according to the output level of the output port 02 of the control unit 200.

In the present embodiment the amount of light emission is maintained at a determined value by controlling the period of power supply to the halogen lamp 5 with an internal timer according to the variation of the power supply voltage. A similar effect can also be obtained by means of an external timer instead of said internal timer.

Now there will be given a detailed explanation on the stabilization of the light source.

As explained in the foregoing, said stabilization is achieved by a digital control according to the present invention. The control circuit shown in FIG. 2 receives a commercial power supply, for example a 100 V AC power supply of 50 Hz or 60 Hz, and performs the phase control of the power supplied to the halogen lamp 5 in such a manner that the effective output voltage to said lamp becomes equal to 75 V.

FIGS. 5-1 to 5-4 are control flow charts of the main routine of the control unit 200 employed in the copier shown in FIG. 1. The control unit 200 starts the operation upon start of the power supply, and executes, in a step 501, initializing steps such as the clearing of the random access memory incorporated in said control unit 200. After enabling the interruption, the control unit awaits the entry of a zero-cross signal through the interruption port INT, and, upon detection of the zero-cross signal, sets a flag F/ZERO SENSE (step 502). Thereafter a step 503 starts a frequency detecting timer (100 msec) incorporated in the control unit 200 in order to detect the frequency of the power supply. During the function of said timer, the start of an interruption program by an external interruption is prohibited.

A succeeding step 504 discriminates the presence of a flag F/FREQUENCY indicating the completion of the frequency detection, and, if absent, the program proceeds to a step 505. Then a step 506 resets the flag F/ZERO SENSE, and the control unit awaits the entry of a succeeding zero-cross signal to the interruption port INT by repeating a loop of the steps 504, 505 and 506. Upon entry of the zero-cross signal, the program proceeds from said loop to a step 507 for discriminating whether the flag F/ZERO SENSE has been set, and, if not, a step 508 is executed to add "1" to a frequency memory in the random access memory, and sets the flag F/ZERO SENSE again. Then the program repeats the loop of the steps 504, 505 and 506 to await the entry of a succeeding zero-cross signal. Through the above-mentioned loop, the frequency memory stores the number of zero-cross signals entered during a period of 100 m sec.

Upon expiration of 100 m sec counted by the timer started in the step 503, an interruption program to be explained later is executed to detect the frequency of the power supply voltage, and the flag F/FREQUENCY is correspondingly set. Thus the program proceeds from the step 504 to a step 509 to light the power supply lamp 221 in the operation unit, to store, in response to the detected frequency, a timer value and a correction coefficient for the phase control, both stored in advance in the read-only memory (ROM), into a determined area of the random access memory in which X-register is 0, 1 or 2, and to enable the entry of a zero-cross signal to the interruption port INT of the control unit 200. Tab. 2 shows the RAM map for the values stored for a frequency of 50 Hz. The timer values are stored in an area corresponding to X-register=0 or 1, and the correction coefficients are stored in an area corresponding to X-register=2.

Then a step 510 awaits the setting of a flag F/COPY which is to be set by a copy start instruction from the operation unit 206. Upon identification of said setting, a step 511 is excuted to drive the main motor 208, sheet feeding clutch 210 and high-voltage source 212 and set flag F/AUTO in advance, which is to be set upon expiration of the operation of the timer.

A setp 512 discriminates the presence of a flag F/50 HZ which is to be set when the frequency of the power supply voltage is identified as 50 Hz by the interruption program for frequency detection, and, if it is already set, sets a timer for pre-rotation step for 50 Hz, or, if not, set a timer for pre-rotation step for 60 Hz. In this manner manual frequency setting is no longer necessary since the available power frequency is detected and the corresponding operation control is automatically effected.

A step 513 resets the flag F/AUTO thereby starting the pre-rotation timer set in the step 512, and the program proceeds to a step 514.

TABLE 2

| Input voltage | Y-register | X-register 0 | 1 | 2 | 3 . . . |
|---|---|---|---|---|---|
| 136–139.5 | F | 1 | A | 1 | |
| 132–135.5 | E | 1 | B | 1 | |
| 128–131.5 | D | 1 | D | 1 | |
| 124–127.5 | C | 1 | F | 1 | |
| 120–123.5 | B | 2 | 2 | 1 | |
| 116–119.5 | A | 2 | 4 | 1 | |
| 112–115.5 | 9 | 2 | 7 | 2 | |
| 108–111.5 | 8 | 2 | A | 2 | |

TABLE 2-continued

| Input voltage | Y-register | X-register 0 | 1 | 2 | 3 . . . |
|---|---|---|---|---|---|
| 104–107.5 | 7 | 2 | D | 2 | |
| 100–103.5 | 6 | 3 | 0 | 2 | |
| 96–99.5 | 5 | 3 | 4 | 3 | |
| 92–95.5 | 4 | 3 | 9 | 3 | |
| 88–91.5 | 3 | 3 | E | 4 | |
| 84–87.5 | 2 | 4 | 4 | 5 | |
| 80–83.5 | 1 | 4 | B | 6 | |
| -80 | 0 | 5 | 5 | 7 | |

The step 514 summons a timer setting routine CVR for determining the lighting time of the halogen lamp as will be explained later, and repeats said routine until the flag F/AUTO is set upon termination of the operation of the pre-rotation timer.

Upon said termination a step 515 is executed to discriminate, by the home position sensor PS1, whether the optical system is present at the home position. If it is at the home position, a step 516 turns off the sheet feeding clutch 210, and, if the transfer sheet is normally fed by the sheet feeding clutch 210 to activate the sheet feeding sensor 205, a step 517 is executed to subtract "1" from the number display memory for displaying the set copy number. If the result of said subtraction is equal to "0" a flag F/STOP is set while said result is not "0" the program proceeds to a step 518.

On the other hand, in case the sheet feeding sensor 205 is not activated because of the lack of normal sheet feeding from the cassette 16, a step 551, identifying the absence of sheet in the cassette 16, light the no-paper lamp 214 and sets a flag F/NO-PAPER and the program proceeds to a step 538.

In the step 518, the optical system forward-clutch 213 is turned on to start the scanning of the original. Then a step 519 calls the timer setting routine CVR. Upon actuation of the registering sensor PS2 by the optical system, a step 521 turns of the registering clutch 211 for advancing the transfer sheet to the image transfer area and sets a flag F/REGISTER ON, and, upon detection of said flag in a step 520, a loop of steps 522 and 523 are repeated until the end of actuation of the registering sensor PS2 by the optical system or until the setting of a flag F/REGISTER OFF indicating the completion of the operation of the registering clutch 211.

A step 524 applies a developing bias to start the developing operation of the developing device 15, turns off the registering clutch 211, sets a corresponding flag F/REGISTER OFF and turns of the sheet feeding clutch 210. A step 525 discriminates, by the exit sensor 204, whether the transfer sheet having subject to the preceding image transfer is ejected in normal manner to the tray 28. In case of normal ejection a flag F/FEED OUT indicating a sheet jamming at the exit is reset, while in case of absence of normal ejection the program proceeds to a step 526.

The step 526 discriminates whether the optical system has reached the end point of forward stroke and activates the reversing position sensor PS3. If it is not yet activated, the program proceeds to a step 519 to repeat the timer setting routine CVR until the sensor PS3 becomes activated. In this case the program jumps from the step 522 to the step 525 since the flag F/REGISTER OFF is already set.

Upon activation of said sensor PS3, the optical system forward clutch 213 is turned off, whereby the optical system terminates the forward movement and starts the reversing movement. Also if the flag F/FEED OUT indicating a sheet jamming in the area of the exit sensor 204 is already set when the optical system reaches the reversing position (step 528) or the exit sensor 204 does not detect a transfer sheet at this point (step 530) a sheet jamming is identified and the program proceeds to a step 549.

On the other hand, if the flag F/FEED OUT is not set, the aforementioned flags F/REGISTER ON and F/REGISTER ON are reset. Also if the exist sensor 205 is not activated, a step 531 awaits that the reversing position sensor PS3 is turned off by the reversing movement of the optical system, and the program then proceeds to a step 532.

The step 532 discriminates the presence of a flag F/STOP which is to be set by the actuation of the stop key by the operator or at the completion of the copying cycles of the set number. If said flag is not set, a step 533 is executed to turn on the sheet feeding clutch 210 for feeding a succeeding transfer sheet from the cassette On the other hand, if it is not set, the program proceeds to a step 534 without the sheet feeding operation.

The step 534 repeats the timer setting routine CVR until the registering sensor PS2 is activated by the returning optical system, and, upon said activation, a step 535 turns off the developing bias. Then a succeeding step 536 again repeats the timer setting routine CVR until the end of activation of the registering sensor PS2 by the optical system.

A step 537 discriminates the present of the flag F/STOP, and, if absent, sets the flag F/FEED OUT. Then the program jumps to the step 511 to start the succeeding copying operation.

In case the flag F/STOP is set, a step 538 stops the optical system at the home position, sets a stay jam timer and resets the flag F/AUTO for starting said timer. Then a step 539 repeats the timer setting routine CVR until the detection of the transfer sheet by the exit sensor 204 and detects a stay jamming by a fact whether the transfer sheet passes the exit sensor 204 before the expiration of the stay jam timer set in the step 538. More specifically, if the stay jam timer expires before the exit sensor 204 is turned off and the flag F/AUTO is thus set, a jamming state is identified and the program jumps to a step 549.

On the other hand, in the absence of stay jamming wherein the exit sensor 204 is turned off before the expiration of the stay jam timer, a step 540 sets the flag F/AUTO and program proceeds to a step 541.

The step 541 discriminates the state of the flags F/NO-PAPTER and F/STOP.

If both flags are absent, a step 542 enables the forward movement of the optical system, and the program returns to the step 511 for initiating the succeeding copying operation.

On the other hand, at least either flag is set, the program proceeds to a step 543 to turn off the high-voltage source for terminating the copying operation to set a post-rotation timer and to reset the flag F/AUTO for starting said timer, thereby controlling the post-rotation step of the apparatus. Then a step 544 repeats the timer setting routine CVR until the expiration of said post-rotation timer.

A succeeding step 545 enables the movement of the optical system. Then a step 546 again discriminates the state of the flags F/NO-PAPER and F/STOP, and, if neither is set, the program returns to the step 511 to start the succeeding copying operation.

On the other hand, in case at least either flag is set, a step 547 resets the flags F/COPY and F/STOP and turns off the main motor 208. Then the state of the flag F/NO-PAPER is identified again, and, if set, said flag is reset, or, if not set, the display is restored to the initial state and the program returns to the step 510 for awaiting the setting of the flag F/COPY by the entry of the succeeding copying instruction.

In case a jamming is found in one of the steps 528, 530 and 539, the program jumps to steps 549 and 550 for jam handling. The step 549 turns off the main motor 208, sets a flag F/JAM indicating a jam detection, turns off the high-voltage source 212 and terminates the drive of the optical system. The step 550 causes the flashing of the jam display 215 at an interval of 0.5 seconds.

Figure 6:
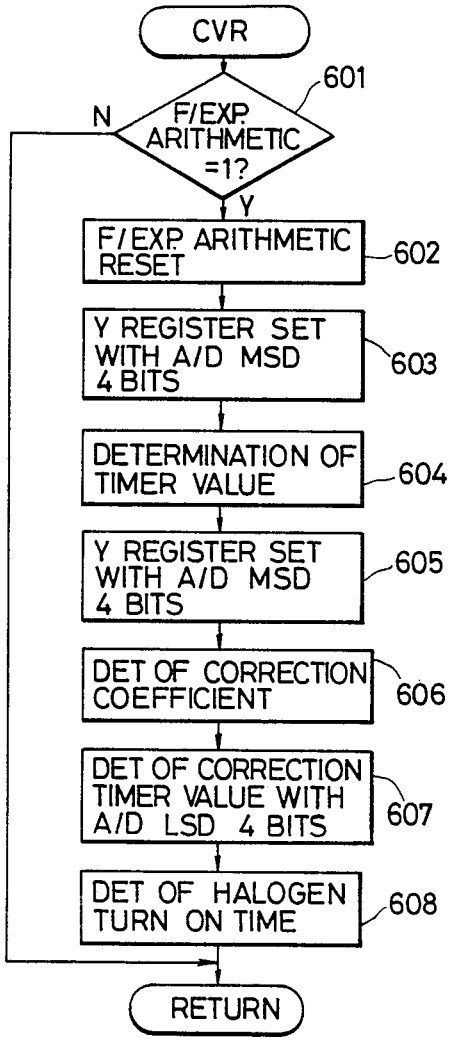
FIG. 6 is a flow chart showing a timer setting routine.
Figure 8:
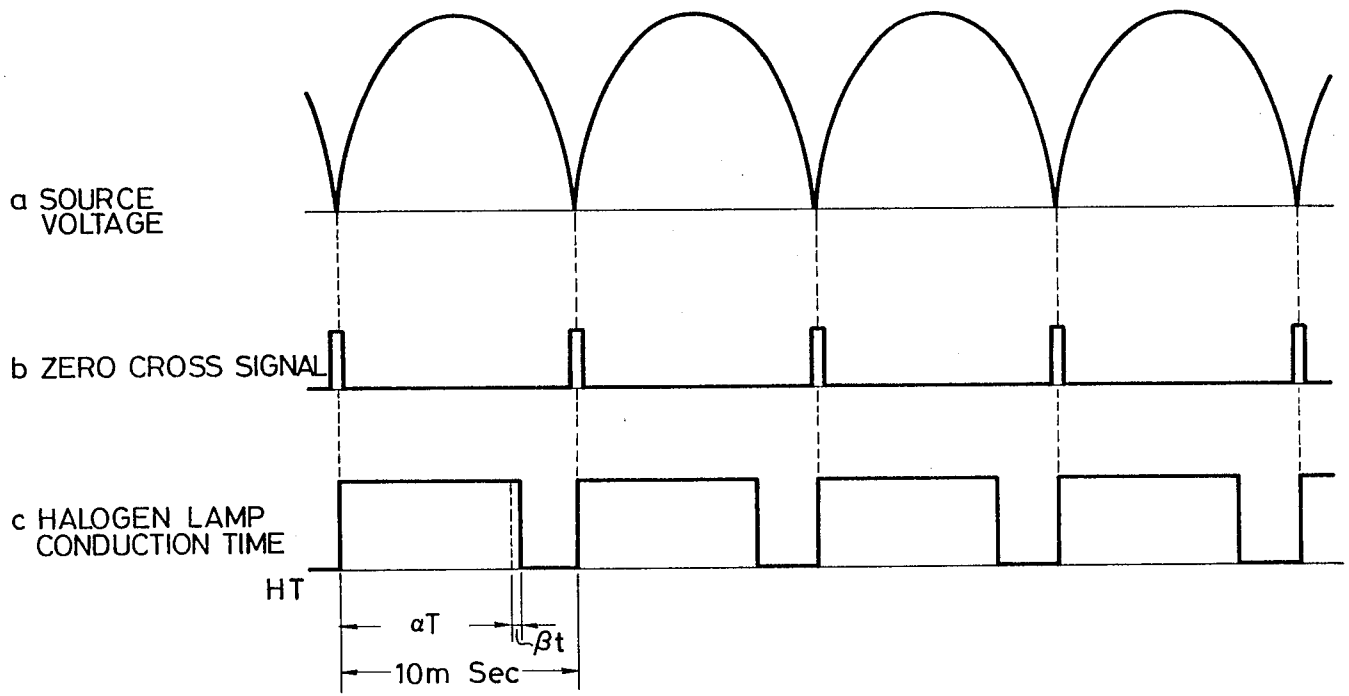
FIG. 8 is a chart showing the power supply to the halogen lamp.

FIG. 6 is a flow chart of the timer setting routine CVR referred to in FIGS. 5-1 to 5-4, which determines the energizing period of the halogen lamp 5 within a half cycle of the power supply voltage, said period being determined from the zero-crossing point of said power supply voltage. Said energizing period is measured by a first timer of a period of $\alpha$ μsec, for example 50 μsec shorter than the period of the AC power supply voltage, and by a second timer of a shorter period of $\beta$ μsec, for example 12 μsec equal to the instruction cycle of the microcomputer, both timers being incorporated in the microcomputer 200. The first timer measures the approximate time while the second timer effects mores detailed time correction as shown in FIG. 8.

Now there will be given an explanation on the flow chart shown in FIG. 6. A step 601 discriminates the state of a flag F/EXPOSURE ARITHMETIC indicating whether or not to enable a timer setting operation by the timer setting routine in case it is called by the main routine. If said flag is set an exposure arithmetic calculation is effected, but, if said flag is not set, the program returns to the main routine without said calculation.

In case said flag is set, a step 602 is executed to reset said flag, whereby the timer setting routine does not function unless said flag is set at the end of energization of the halogen lamp. Consequently the timer setting routine is executed once at most from the entry of a zero-crossing signal to the entry of a succeeding zero-crossing signal.

A step 603 sets, into the Y-register, the upper 4 bits of the voltage value stored in the random access memory in a form of 8-bot digital value. As an example, a power supply voltage of 97.5 V is converted by the control unit 200 according to the conversion table 1 into digital value $(56)_{16}$ in hexadecimal representation or $(01010110)_2$ in binary representation. Thus the upper 4 bits, i.e. $(5)_{16}$ is set in the Y-register.

A step 604 determines a timer value T, according to the RAM may shown in Tab. 2, stored in the X-register areas of 0 and 1 corresponding to the value of Y-register set in the step 603. As an example, for a Y-register setting of $(5)_{16}$, the timer value T is determined as $(34)_{16}$ from Tab. 2.

Again a step 605 sets, in the Y-register the upper 4 bits of the voltage value converted into digital form by the A/D converter.

A step 606 determines a correction coefficient, according to the RAM map shown in Tab. 2, stored in the X-register area of 2 corresponding to the value of Y-register set in the step 605. As an example, for a Y=register setting of $(5)_{16}$, the correction coefficient is determined as $(3)_{16}$ from Tab 2.

A step 607 determines a correction timer value t according to a correction timer chart shown in Tab. 3, from the lower 4 bits of the voltage value converted into digital form by the A/D converter and from the correction coefficient determined in the step 606. As an example, for a power supply voltage of 97.5 V, the correction coefficient and the lower 4 bits of the input voltage value are respectively $(3)_{16}$ and $(6)_{10}$, so that the correction timer value t is determined as 6 from Tab. 3.

A step 608 determines a halogen lamp lighting time HT from the timer value T determined in the step 604 and the correction timer value t determined in the step 607 according to the following equation (1):

$$HT=\alpha T+\beta t \quad (1)$$

wherein $\alpha$ and $\beta$ are the period of one cycle of the first timer and of the second timer respectively.

TABLE 3

| | Cor. eff. | | | | | | | |
|---|---|---|---|---|---|---|---|---|
| Lower bits | 1 | 2 | 3 | 4 | 5 | 6 | 7 | 8 |
| 2 | 1 | 2 | 2 | 3 | 3 | 4 | 4 | 5 |
| 4 | 2 | 3 | 4 | 5 | 6 | 7 | 8 | 9 |
| 6 | 3 | 5 | 6 | 8 | 9 | 11 | 12 | 14 |
| 8 | 4 | 6 | 8 | 10 | 12 | 14 | 16 | 18 |
| A | 5 | 8 | 10 | 13 | 15 | 18 | 20 | 23 |
| C | 6 | 9 | 12 | 15 | 18 | 21 | 24 | 27 |
| E | 7 | 11 | 14 | 18 | 21 | 25 | 28 | 32 |

As explained in the following the routine detects the power supply voltage, converts said voltage into a digital value and accordingly determines the halogen lamp lighting time HT, and the program then returns to the main routine.

$\alpha$T and $\beta$t in the right-hand term of the equation (1) are respectively measured by the aforementioned first timer of a period $\alpha$ μsec and the second time of a period $\beta$ μsec, both incorporated in the microcomputer.

As an example, for a power supply voltage of 97.5 V, the timer value T is $(34)_{16}$ while the correction timer value t is 6 as explained before, so that the halogen lighting time HT is calculated as follows:

$$HT=\alpha\times(34)_{16}+\beta\times 6\ (\mu sec).$$

FIG. 8 shows the power supply state to the halogen lamp 5 according to the halogen lamp lighting time determined according to the foregoing explanation, wherein (a) shows the all-wave rectified waveform of the power supply voltage, (b) shows the zero-crossing signals supplied to the interruption port INT, and (c) shows the energizing time HT of the halogen lamp 5.

As will be apparent from FIG. 8, the energizing or lighting time is controlled between the entry of a zero-cross signal to the entry of a succeeding zero-cross signal, wherein a determined period from the entry of the first zero-cross signal is measured by said first timer, while the second timer starts time measurement at the expiration of said first timer and the lighting of the halogen lamp 5 is terminated at the expiration of said second timer. Stated differently the first timer determines the approximate lighting time and the second timer performs a fine correction. In this manner it is rendered possible to reduce the digitizing error in a digital control, thereby achieving an accurate light control.

Figures 1, 7:
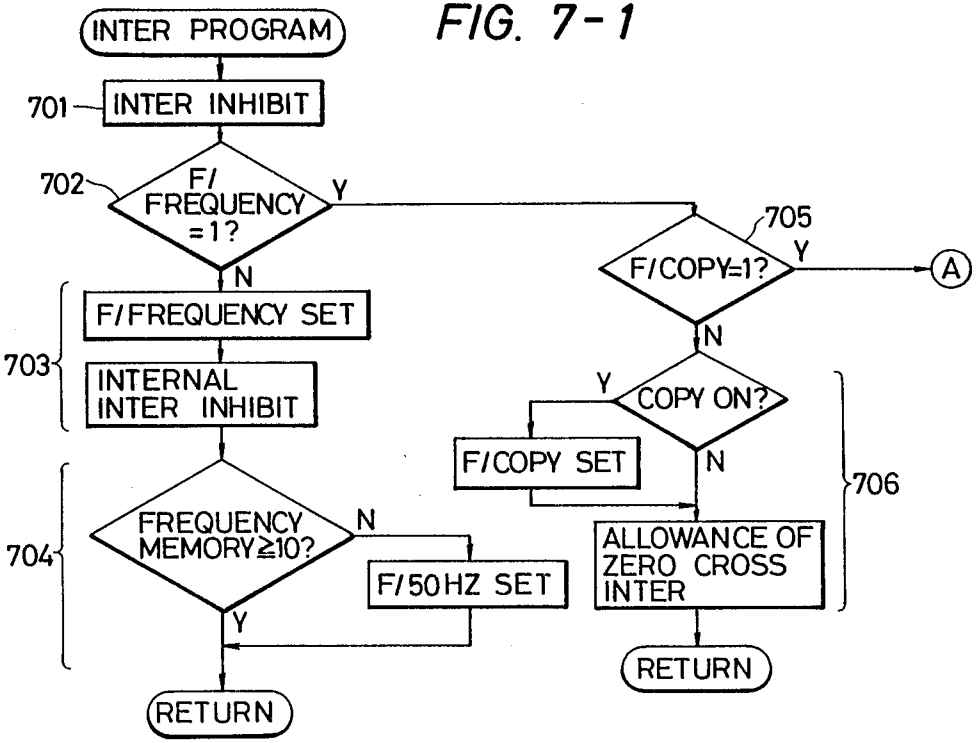
Figures 2, 7:
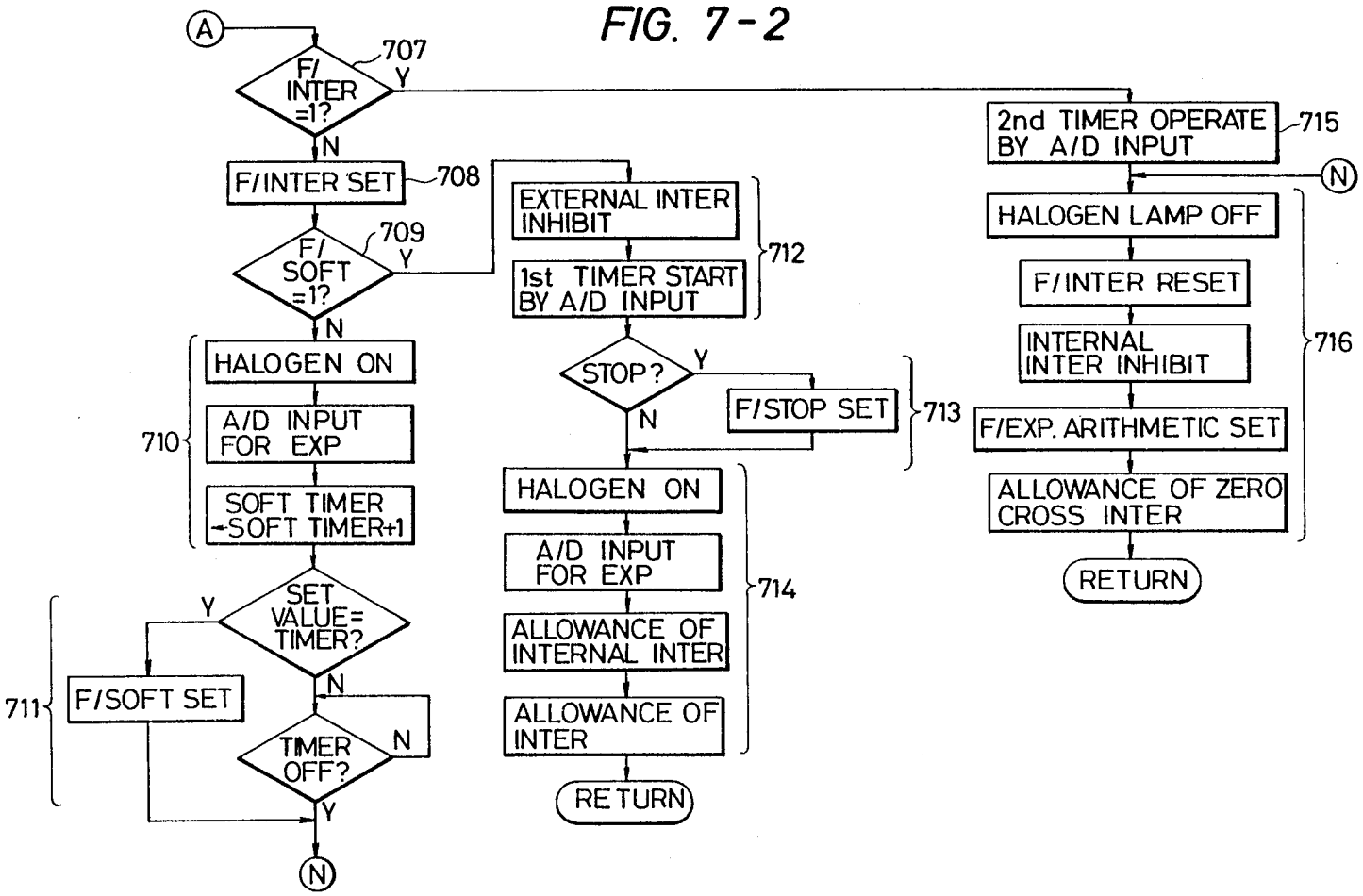

FIG. 7 shows the interruption program of the control unit 200, of which sequence control can be interrupted by a zero-cross signal supplied to the interruption port INT and by the expiration of an internal timer.

The interruption program shown in FIG. 7 has the following three functions of detecting the frequency of the power supply voltage, effecting a soft starting of the lighting of the halogen lamp 5, and conducting a phase control in the normal lighting of the halogen lamp 5.

At first there will be explained the first function of frequency detection. As already explained in relation to the main routine, at the start of power supply, a frequency detection timer of 100 msec is started by the entry of a zero-cross signal after the interruption step is enabled (FIG. 5-1).

During the function of said timer the external interruption by a zero-cross signal entered through the interruption port INT is inhibited. Upon expiration of the period of said 100 msec, an internal interruption is instructed to execute the interruption program shown in FIG. 7. At first a step 701 inhibits all the internal and external interruptions. Then a step 702 discriminates the state of the flag F/FREQUENCY indicating whether or not the frequency detection has been completed. The program proceeds to a step 703 at the start of power supply since the random access memory is cleared to reset all the flags in this state.

A succeeding step 703 sets the above-mentioned flag F/FREQUENCY and again inhibits the internal interruption. A step 704 checks the value of the frequency memory explained in relation to the main routine. If nine or less zero-cross signals are received during the timer period of 100 msec., the input power supply is identified as 50 Hz and the flag F/50 HZ is set before the program returns to the main routine. On the other hand, in case the value of the frequency memory is equal to or in excess of 10, the input power supply is identified as 60 Hz and the program returns to the main routine without setting said flag F/50 HZ. The detection of the frequency of the input power supply is conducted in this manner.

Now there will be explained the second function of soft starting for the halogen lamp 5. Transistors and triacs in the lighting circuit for the light source such as the halogen lamp may be damaged by a surge current generated at the start of lighting. In order to prevent such phenomenon the voltage applied to the light source is gradually increased from 0 V at the starting, and such process is called a soft start.

Figure 9:
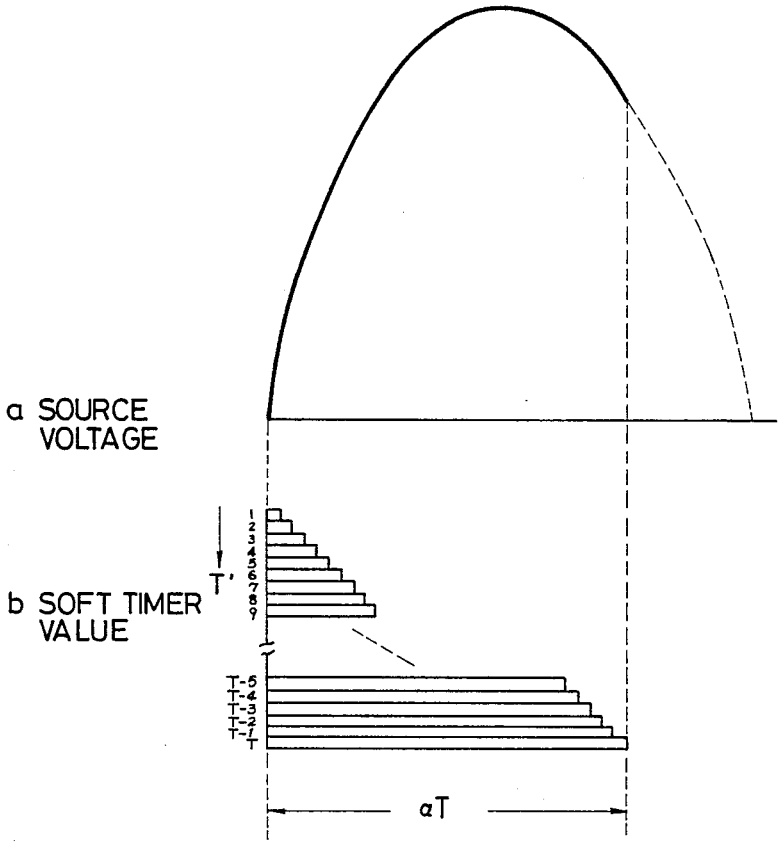
FIG. 9 is a chart showing the soft start at the start of lighting.

FIG. 9 shows the procedure of soft starting.

After the frequency detection, setting of the flag F/FREQUENCY and enabling of the zero-cross interruption in the step 509 of the main routine, the interruption program shown in FIG. 7 is called in response to a zero-cross signal entered into the interruption port INT. In this case the program proceeds from the step 702 to a step 705 for detecting a flag F/COPY indicating that the copy key has been actuated. If said flag is not set, a step 706 is executed to detect the actuation of the copy key. The flag F/COPY is then set or not respectively if the copy key is actuated or not, then the interruption by the zero-cross signal is enabled, and the program returns to the main routine. Thereafter the above-mentioned procedure is repeated in response to each entry of the zero-cross signal, and the program proceeds to a step 707 in response to the entry of a zero-cross signal if the flag F/COPY is set in this state.

The step 707 discriminates the state of a flag F/INTERRUPTION indicating that an interruption process by an interruption signal is being executed. If said flag is not set, a step 708 sets the flag F/INTERRUPTION, and the program proceeds to a step 709 for discriminating the state of a flag F/SOFT indicating the completion of soft starting of the halogen lamp 5. Since said flag is not yet set at the initial stage of the lamp starting, a step 710 is executed to light the halogen lamp 5, to receive the power supply voltage through the analog-to-digital converting port A/D and to add "1" to the value of a soft timer T'. Said value indicates the counting of a timer of 50 μsec same as the aforementioned first timer.

A step 711 compares the soft timer value T' increased in the step 710 with the timer value T of the first timer determined in the timer setting routine shown in FIG. 6. If these two values do not coincide each other, the program proceeds, upon expiration of the time measurement by the soft timer value T', to a step 716 to turn off the halogen lamp, to reset the flag F/INTERRUPTION, to inhibit the internal interruption and to set a flag F/EXPOSURE ARITHMETIC enabling the timer setting operation by the timer setting routine. Also the interruption by the zero-cross signal is enabled and the program returns to the main routine. Thereafter a step 710 increases the soft timer value T' stepwise in response to each zero-cross signal until the step 711 identifies the coincidence of the soft timer value T' with the timer value T determined by the timer setting routine.

In this manner the lighting time of the halogen lamp started by a zero-cross signal is increased gradually by a count of the first timer which is equal to $\alpha$ μsec., as shown by a curve b in FIG. 9.

Upon coincidence of the soft timer value T' with the first timer value T, the flag F/SOFT is set and the program returns to the main routine through the step 716.

As explained in the foregoing, the power supply period to the halogen lamp 5 is increased, at the start of lighting, by a determined period ($\alpha$ μsec) from zero to $\alpha$T μsec, thereby achieving a gradual increase of the voltage supplied to the halogen lamp.

Figure 10:
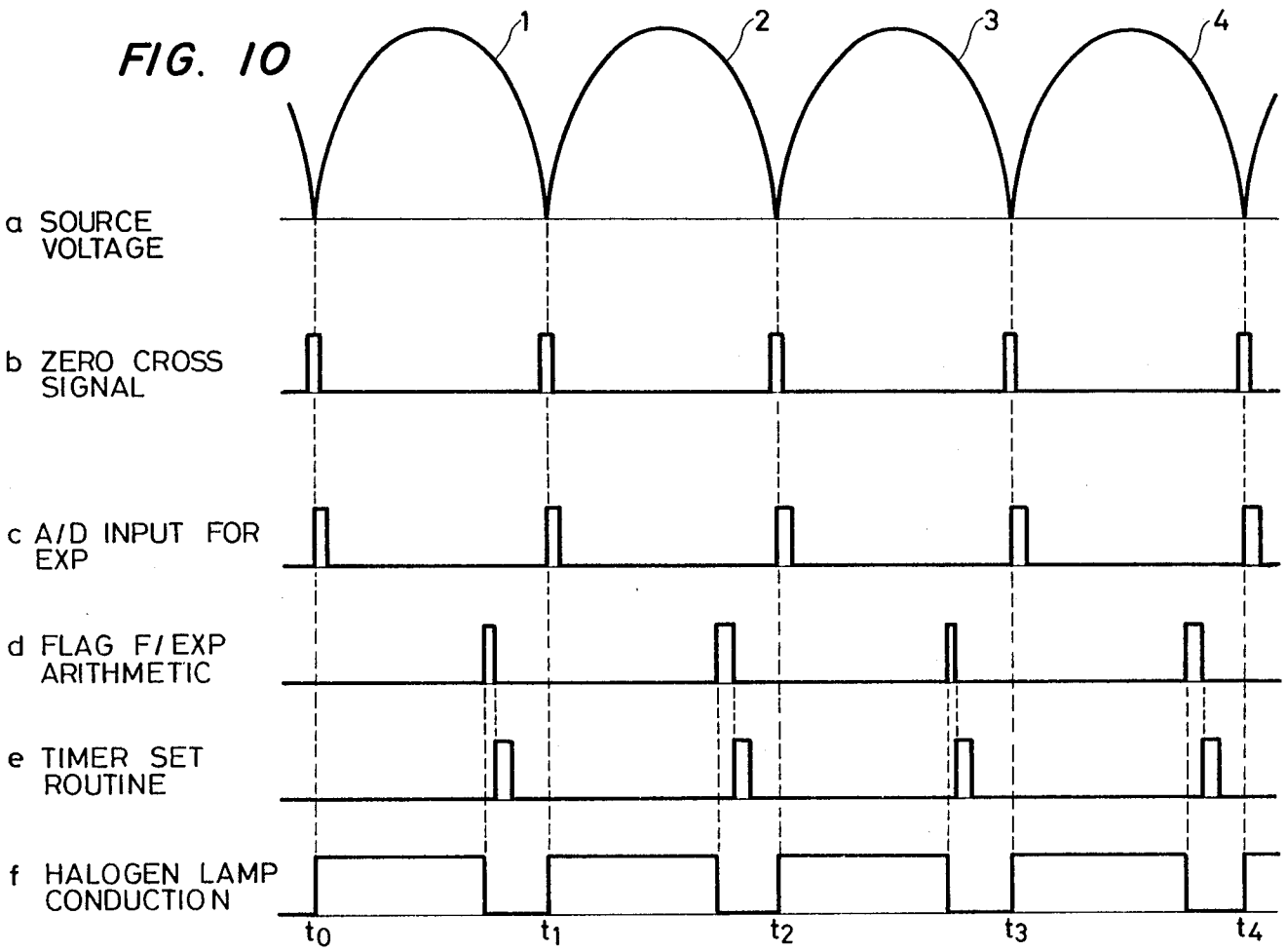
FIG. 10 is a timing chart showing the state in normal lighting state.

Now there will be explained the third phase control function during the normal lighting. FIG. 10 is a timing chart in the normal lighting, wherein (a) indicates a waveform of the input power supply after all-wave rectification, (b) indicates zero-cross signals entered to the interruption port INT, (c) shows A/D input signals obtained from the peak values of the peak value detecting circuit, (d) shows the state of the flag F/EXPOSURE ARITHMETIC enabling the timer setting routine shown in FIG. 6. (e) shows the function timings of the timer setting routine, and (f) shows the power supply periods to the halogen lamp. The relative lengths of time in FIG. 10 are arbitrarily selected for the convenience of explanation and do not represent absolute times.

In this function, in response to a zero-cross signal received at the interruption port INT after the completion of the aforementioned soft starting, a step 708 sets the flag F/INTERRUPTION, and the program proceeds from the step 709 to a step 712 to inhibit the external interruption and to start the time measurement of the first timer value selected by the timer setting routine shown in FIG. 6. Then, if the flag F/STOP is not set in a step 713, the program proceeds to a step 714 to light the halogen lamp 5. Then the peak value of the power supply voltage (a) detected by the peak value detecting circuit 220 after the entry of a preceding zero-cross signal is read through the analog-to-digital converting port A/D of the control unit 200, converted into an 8-bit digital value according to the conversion table shown in Tab. 1 and stored in the determined area of the random access memory as explained in the foregoing. In this manner the peak values of the waveforms 1, 2, 3 and 4 are respectively read at times t1, t2, t3 and t4. The timer value is determined, in response to thus stored values, according to the timer setting routine shown in FIG. 6. After each peak value reading, the peak value detecting circuit 220 is reset by a signal from the reset port RESET for starting the peak value detection anew.

Thereafter a step 714 enables internal interruption and interruption, and the program returns to the main routine.

Upon expiration of the measurement of the first timer started in the step 712, the control unit 200 executes an internal interruption to call the interruption program shown in FIG. 7. In this case the program proceeds from the step 707 to a step 715 since the flag F/INTERRUPTION is set. The step 715 starts the second timer se by the timer setting routine shown in FIG. 6, and, upon expiration of the function of said second timer, a step 716 is executed to turn off the halogen lamp 5 and set the flag F/EXPOSURE ARITHMETIC of enabling the timer setting routine. Thereafter the program returns to the main routine.

When the timer setting routine CVR explained in the main routine in FIG. 5 is called while the flag F/EXPOSURE ARITHMETIC is set, the timer value is determined by the calculation of the peak value read in synchronization with the zero-cross signals and stored in the digital form in the random access memory as explained in the foregoing. The peak value employed in said calculation is the one detected between the entry of an immediately preceding zero-cross signal and the entry of a further preceding zero-cross signal.

The timer value thus determined is used for controlling the lighting period of the halogen lamp to be started by the entry of a succeeding zero-cross signal.

More specifically, the peak value of the waveform of the power supply voltage is read at the zerocrossing point of the waveform 2, or at a time t1 for calculating the timer value, and said timer value is utilized, at a time t2, for effecting the phase control for the waveform 3. Similarly the peak value of the waveform 2 is read at a time t2 for calculating another timer value, which is used, at a time t3, for effecting the phase control for the waveform 4.

Consequently a timer value obtained from a power supply voltage which was negative before the all-wave rectification is used for the phase control of an originally negative power supply voltage, and vice versa.

Such control process, in which a control signal obtained from an originally positive power supply voltage is used for controlling the supply of an originally positive power supply voltage to the light source and a control signal obtained from an originally negative power supply voltage is used for controlling the supply of an originally negative power supply voltage to the light source, enables an exact control of the amount of light emitted from a light source lighted by a generally asymmetric AC power supply.

Although the power supply to the light source in the foregoing embodiment is started from the aforementioned zero-crossing point, the present invention is by no means limited to such embodiment but is generally applicable to the conventional lighting angle control process utilizing thyristers or the like. Also it is possible to control the gain of the applied voltage instead of the control of the power supply period. Naturally the present invention is also applicable to other light sources than the halogen lamp.

Besides the present invention allows to simplify the circuit structure since the control unit for sequence control of the copying operation is used also for the lighting control of the halogen lamp.

Although the present invention has been explained by an embodiment applied to the light control in an image forming apparatus, it is applicable also for the control of a heater in the fixing device or of the function of a member activated by electric power.

What I claim is:

1. Image processing apparatus comprising:

a plurality of processing means operable for exposing an original document and processing an image of the exposed original document, at least one of said plural processing means including a load member activated by electric power from a power source;

a first control means for controlling the duration of a supply of the electric power to the load member in accordance with an input control signal; and a second control means storing a program for image processing for controlling the operation of said plurality of processing means in accordance with said program, said second control means including a first timer means operable for time counting in a first time cycle, and a second timer means operable for time counting in a second time cycle shorter than the first time cycle, and said second control means being operable to obtain the time counting cycles of said first and second timer means so as to operate said load member in a predetermined condition, and to produce the control signal to said first control means in accordance with the time counting operations of said first and second timer means.

2. Image processing apparatus according to claim 1, wherein said load member is a light source which is variable in the amount of its light emission in accordance with the duration of the supply of electric power.

3. Image processing apparatus according to claim 1, further comprising means for detecting a voltage value of the power source, wherein said second control means determines the time counting cycles of said first and second timer means in accordance with the power source voltage value detected by said detecting means.

4. Image processing apparatus according to claim 1, wherein said load member is adapted to be operated by an AC power supply, said first timer means is adapted to start the time measurement from a zero-crossing point of said AC power supply voltage, and said second timer means is adapted to start the time measurement from the expiration of the time measurement of said first timer means.

5. Image processing apparatus according to claim 1, wherein said load member is adapted to be operated by an AC power supply, and said second control means produces the control signal to control a duration of the supply of power to said load member in each half cycle of said AC power source.

6. Image processing apparatus comprising:

a plurality of processing means operable for exposing an original document and processing an image of the exposed original document, at least one of said plural processing means including a load member activated by electric power from a power source;

a first control means for controlling a supply of the electric power to the load member in accordance with an input control signal; and a second control mean storing a program for image processing for controlling the operation of said plurality of processing means in accordance with said program, said second control means being operable to produce the control signal to said first control means so as to operate said load member in a predetermined operational condition, and said second control means being adapted to produce the control signal so as to increase stepwise the amount of electric power supplied to said load member during a time period starting from initiation of operation of said load member until it reaches said predetermined operational condition.

7. Image processing apparatus according to claim 6, further comprising means for detecting a voltage value of the power source, wherein said second control means produces the control signal in accordance with the power source voltage value detected by said detecting means.

8. Image processing apparatus according to claim 6, wherein said load member is a light source which is variable in the amount of its light emission in accordance with the amount of supply of electric power.

9. Image processing apparatus according to claim 6, wherein said load member is activated by AC power source, and said second control means produces the control signal to control the amount of the supply of power to said load member in each half cycle of said AC power source.

10. Image processing apparatus according to claim 6, wherein said second control means includes timer means which is time-settable in a stepwise manner for control of the time period for the supply of power to said load member.

11. Image processing apparatus comprising:

a plurality of processing means operable for exposing an original document and processing an image of the exposed original document, at least one of said plural processing means including a load member activated by electric power from an AC power source;

means for detecting positive and negative voltages of said AC power source, individually;

a first control means for controlling the supply of the electric power to the load member in accordance with an input control signal; and a second control means storing a program for image processing for controlling the operation of said plurality of processing means in accordance with said program, said second control means being operable to produce the input control signal so as to operate said load member in a predetermined condition, wherein said second control means is adapted to produce the input control signal for controlling the application of the positive voltage to said load member in accordance with the positive voltage detected by said detecting means and to produce the input control signal for controlling the application of the negative voltage to said load member in accordance with the negative voltage detected by said detecting means.

12. Image processing apparatus according to claim 11, wherein said second control means produces the control signal to control duration of power supply to said load member in each half cycle of said AC power source.

13. Image processing apparatus according to claim 11, wherein said load member is a light source which is variable in the amount of its light emission in accordance with the amount of supplied electric power.

14. Image processing apparatus according to claim 11, wherein said second control means is adapted to control the duration of the supply of positive voltage in response to a detected positive voltage and to control the duration of the supply of negative voltage in response to a detected negative voltage.

15. Image processing apparatus comprising:

a plurality of processing means operable for exposing an original document and processing an image of the exposed original document, at least one of said plural processing means including a load member activated by electric power from an AC power source;

means for detecting the zero-cross points of the AC power source for supplying the electric power to said apparatus;

a first control means for controlling a supply of the electric power to the load member in accordance with an input control signal; and a second control means storing a program for image processing for controlling the operation of said plural processing means in accordance with said program, said second control means being operable to produce the control signal to said first control means based on the detection of the zero-cross points by said detecting means so as to operate said load member in a predetermined condition, and said second control means being operable to discriminate the frequency of said AC power source based on the detection of the zero-cross points by said detecting means to control said plural processing means in accordance with the discriminated frequency.

16. Image processing apparatus according to claim 15, wherein said second control means discriminates the frequency of said AC power source based on the number of zero-cross points detected by said detecting means during a predetermined time period.

17. Image processing apparatus according to claim 15, wherein said load member is a light source which is variable in the amount of its light emission in accordance with the amount of supplied electric power.

18. Image processing apparatus according to claim 15, wherein said load member is activated by said AC power source, and said second control means produces the control signal to control the amount of power supplied to said load member in each half cycle of said AC power source.

19. Image processing apparatus according to claim 15, further comprising means for detecting a voltage value of the power source, wherein said second control means produces the control signal in accordance with the power source voltage value detected by said detecting means.

* * * * *